US010358930B2

(12) United States Patent
Ju et al.

(10) Patent No.: US 10,358,930 B2
(45) Date of Patent: Jul. 23, 2019

(54) ASSEMBLING METHOD OF A BUCKET AND A FIXTURE FOR A BUCKET FOR A TURBINE BLADE

(71) Applicant: DOOSAN HEAVY INDUSTRIES & CONSTRUCTION CO., LTD., Gyeongsangnam-do (KR)

(72) Inventors: Young Ho Ju, Gyeonggi-do (KR); Jung Chan Kim, Gyeonggi-do (KR); Seong Jong Yang, Gyeongsangnam-do (KR); Seok Jin Jang, Gyeongsangnam-do (KR); Cheol Hong Kim, Gyeonggi-do (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 370 days.

(21) Appl. No.: 15/224,948

(22) Filed: Aug. 1, 2016

(65) Prior Publication Data

US 2017/0037735 A1 Feb. 9, 2017

(30) Foreign Application Priority Data

Aug. 3, 2015 (KR) ..... 10-2015-0109462

(51) Int. Cl.
*F01D 5/30* (2006.01)
*F01D 5/32* (2006.01)
*F01D 25/06* (2006.01)

(52) U.S. Cl.
CPC ..... *F01D 5/3007* (2013.01); *F01D 5/326* (2013.01); *F01D 25/06* (2013.01);
(Continued)

(58) Field of Classification Search
CPC ..... F01D 5/3007; F01D 5/326; F01D 5/30
See application file for complete search history.

(56) References Cited

U.S. PATENT DOCUMENTS 2,843,356 A 7/1958 Hull, Jr.
4,676,723 A 6/1987 Kiger et al.
(Continued)

FOREIGN PATENT DOCUMENTS

EP 2 613 000 A2 7/2013
EP 2 613 001 A2 7/2013
(Continued)

OTHER PUBLICATIONS

Extended Search Report issued in corresponding European Application No. 16182436.2, dated Dec. 5, 2016, 9 pages.
(Continued)

*Primary Examiner* — Kenneth Bomberg
*Assistant Examiner* — Michael L Sehn
(74) *Attorney, Agent, or Firm* — Invenstone Patent, LLC

(57) ABSTRACT

Disclosed herein is a fixture for a bucket for a turbine blade. The fixture includes a rotor wheel that includes a plurality of dovetail grooves. A platform seat is formed between the dovetail grooves and provided with a first insertion groove in a circumferential direction. A bucket includes a platform that inserts into one of the dovetail grooves. A base platform disposed on an upper surface of the platform includes a second insertion groove at a position facing the first insertion groove.

17 Claims, 12 Drawing Sheets

(52) U.S. Cl.
CPC ..... *F05D 2220/31* (2013.01); *F05D 2230/60* (2013.01); *F05D 2230/644* (2013.01); *F05D 2260/30* (2013.01)

(56) References Cited

U.S. PATENT DOCUMENTS

| | | | | |
|---|---|---|---|---|
| 4,767,247 | A * | 8/1988 | Partington | F01D 5/22 416/193 A |
| 4,915,587 | A * | 4/1990 | Pisz | F01D 5/326 416/220 R |
| 8,277,186 | B2 * | 10/2012 | Tanaka | F01D 5/225 415/220 |
| 8,562,301 | B2 * | 10/2013 | Jan | F01D 5/323 29/889.1 |
| 2009/0290983 | A1 | 11/2009 | Tanaka | |
| 2011/0229328 | A1 | 9/2011 | Rajagopalan | |
| 2015/0167469 | A1 | 6/2015 | Deallenbach et al. | |

FOREIGN PATENT DOCUMENTS

| | | | |
|---|---|---|---|
| JP | S61-147302 | U | 7/1986 |
| JP | 2009-281365 | A | 12/2009 |
| KR | 10-2011-0098935 | A | 9/2011 |
| WO | 2009/019126 | A1 | 2/2009 |

OTHER PUBLICATIONS

A Korean Office Action dated Jun. 16, 2016 in connection with Korean Patent Application No. 10-2015-0109462 which corresponds to the above-referenced U.S. application.

* cited by examiner

ASSEMBLING METHOD OF A BUCKET AND A FIXTURE FOR A BUCKET FOR A TURBINE BLADE

CROSS-REFERENCE TO RELATED APPLICATION

This application claims priority to Korean Patent Application No. 10-2015-0109462, filed on Aug. 3, 2015, the disclosure of which is incorporated herein by reference in its entirety.

BACKGROUND

Exemplary embodiments of the present disclosure relate to a bucket mounted on a rotor wheel of a turbine, and more particularly, to a fixture for a bucket for a turbine blade and an assembling method of a bucket using the same for easy installation of a plurality of buckets installed along a circumferential direction of a rotor wheel.

Generally, a steam turbine is an apparatus for rotating buckets with blades with high temperature and high pressure steam generated from a large-capacity boiler for a power station to convert into rotary power which is kinetic energy and is generally divided into a high pressure turbine, an intermediate pressure turbine, and a low pressure turbine to maximize efficiency.

The steam turbine includes a casing forming an appearance and a frame of the turbine and a rotor rotatably installed in the casing.

Each bucket includes a blade part and a root part, in which the root part includes a platform that is formed at a radial internal end of the blade part and a dovetail that is formed at a radial internal end of the platform.

Generally, the foregoing dovetail may be largely divided into a tangential entry type, an axial entry type, a pinned finger type, and a key axial shape according to a method for coupling a dovetail with a rotor.

In the case of the axial entry type bucket in which the bucket is inserted into and fastened with the dovetail in an axial direction of the rotor, the bucket is fixed in a tangential direction of the rotor by the dovetail but is not fixed in an axial direction of the rotor, and therefore there is a problem in that the bucket is separated during a driving of the turbine.

To solve the above problem, the axial entry type used the axial fixture for the bucket. However, in the existing axial entry type, the axial fixture of the bucket has a complicated configuration, and therefore there is a problem in that it takes much time and costs to perform the axial fixing.

Further, in the existing axial entry type, the axial fixture has a complicated configuration, and therefore there is a problem in that manufacturing costs are increased.

In addition, in the existing axial entry type, the axial fixture of the bucket may not firmly fix the bucket in the axial direction and in severe cases, the bucket is separated from the rotor due to vibrations depending on the driving of the turbine, and therefore there is a problem in that a safety accident is caused.

BRIEF SUMMARY

In accordance with one aspect of the present disclosure, a fixture for a bucket for a turbine blade includes: a rotor wheel configured to have a plurality of dovetail grooves having a predetermined diameter in axial direction of a rotor and disposed to be spaced apart from each other along a circumferential direction and a platform seating part formed between the dovetail grooves and provided with a first insertion groove in a circumferential direction; a bucket configured to have platforms inserted into the dovetail grooves, respectively and a base platform formed on an upper surface of the platform and provided with a second insertion groove formed at a position facing the first insertion groove; a first fixture configured to be fitted in an internal area formed by the first and second insertion grooves; a second fixture configured to be positioned on a lower surface of a final bucket to fix the final bucket among the buckets mounted on the rotor wheel and be inserted into the internal area formed in the first and second insertion grooves; and an auxiliary fixture configured to be inserted into an opening hole formed in the base platform of the final bucket facing the second fixture.

The first insertion groove may be formed at a leading position corresponding to a front end with respect to an axial direction in an upper surface of the platform seating part.

The first insertion groove may be formed at a central position with respect to a center of the upper surface of the platform seating part or any position between the front end and the center.

The platform seating part may be provided with a stepped portion stepped upwardly from a back end and provided with a protrusion protruding from the bucket and a lower surface of the platform of the final bucket and the stepped portion and the protrusion may be maintained in a state in which they are engaged with each other.

The second insertion groove may have a partition wall formed at a position facing the first fixture with respect to a direction in which the first fixture is inserted into the second insertion groove to maintain the first fixture in a state inserted into a specific position when the first fixture is inserted into the second insertion groove.

The second fixture may include: a body part configured to be extended by a predetermined length so that it is inserted into the first insertion groove and have a third insertion groove formed at a position facing the second insertion groove; and a protruding piece configured to protrude upwardly in a length direction of an upper surface of the body part spaced apart from the third insertion groove; and blade parts configured to be downwardly inclined backwardly from length directions of left and right sides of the protruding piece.

The auxiliary fixture may have an upper surface going through caulking processing after it is inserted into the second fixture to be maintained in a state in which it is fixed to the final bucket.

The fixture may further include: an adjustment member configured to be inserted between the platform seating part and a lower surface of the platform of the bucket to adjust a coupled position of the auxiliary fixture fixed to the second fixture.

The second fixture may move in front and back directions of the second insertion groove depending on a depth at which the adjustment member is inserted.

The final bucket may include: a vane configured to be extended toward an upper portion of an outer side with respect to the base platform; and a shroud configured to be provided at an upper end of the vane and provided with an extending surface to which an opposite surface toward the adjacent buckets is flatly extended.

In accordance with another aspect of the present disclosure, an assembling method of a bucket includes: a first bucket inserting step of inserting a first bucket into any one of a plurality of dovetail grooves provided on a circumferential direction of a rotor wheel and then performing assembling in a state in which the first bucket is engaged with a leading position corresponding to a front end and a trailing position corresponding to a back end, respectively, with respect to an axial direction of the first bucket; a step of fixing the first bucket using a fixture; a second to n-th bucket fixing step of fixing the first bucket and then sequentially fixing the rest buckets to the dovetail grooves adjacently disposed to the first bucket; and a step of inserting a final bucket into the dovetail groove and fixing the final bucket by positioning of the fixture.

In the step of fixing the final bucket, a regular position adjustment may be performed on the fixture by selectively adjusting an insertion depth of the adjustment member inserted into a lower surface of the platform of the final bucket.

The step of fixing the final bucket may include: a step of performing the regular position adjustment on the fixture and then inserting an auxiliary fixture coupled with the fixture at the outer side of the final bucket; and a step of performing the caulking processing on an upper surface of the auxiliary fixture to prevent the auxiliary fixture from being separated.

It is to be understood that both the foregoing general description and the following detailed description of the present disclosure are exemplary and explanatory and are intended to provide further explanation of the invention as claimed.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION

An object of the present disclosure relates to a fixture for a bucket for a turbine blade and an assembling method of a bucket using the same for a worker to easily mount a plurality of buckets and a final bucket mounted on a rotor wheel of a turbine.

Other objects and advantages of the present disclosure can be understood by the following description, and become apparent with reference to the embodiments of the present disclosure.

Figure 1:
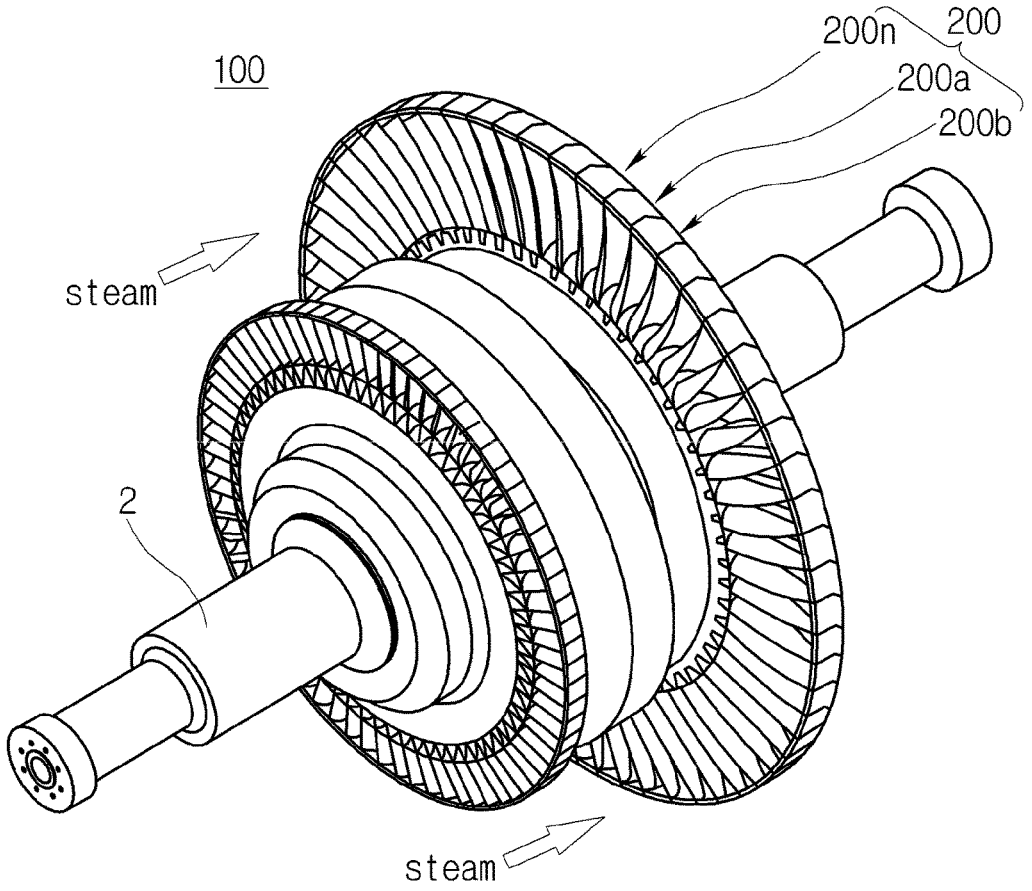
FIG. 1 is a perspective view illustrating a rotor wheel mounted on a fixture for a bucket for a turbine blade according to one embodiment of the present disclosure.

A fixture for a bucket for a turbine blade according to one embodiment of the present disclosure will be described with reference to the accompanying drawings. FIG. 1 is a perspective view illustrating a rotor wheel mounted on a fixture for a bucket for a turbine blade according to one embodiment of the present disclosure and FIGS. 2 to 5 are perspective views illustrating a fixed state using a first fixture of the fixture for a bucket for a turbine blade according to one embodiment of the present disclosure.

Referring to FIGS. 1 to 8, the fixture for a bucket for a turbine blade according to the embodiment of the present disclosure includes: a rotor wheel 100 configured to have a plurality of dovetail grooves 110 having a predetermined diameter in axial direction of a rotor 2 and disposed to be spaced apart from each other along a circumferential direction and a platform seating part 120 formed between the dovetail grooves 110 and provided with a first insertion groove 122 in a circumferential direction; buckets 200 configured to have platforms 202 inserted into the dovetail grooves 110, respectively and a base platform 205 formed on an upper surface of the platform and provided with a second insertion groove 201 formed at a position facing the first insertion groove 122; a first fixture 300 configured to be fitted in an internal area formed by the first and second insertion grooves 122 and 201; a second fixture 400 configured to be positioned on a lower surface of a final bucket **200*n* to fix the final bucket 200*n* among the buckets 200 mounted on the rotor wheel 100 and be inserted into the internal area formed in the first and second insertion grooves 122 and 201; and an auxiliary fixture 500 configured to be inserted into an opening hole 206 formed in the base platform 205 of the final bucket 200*n* facing the second fixture 400**.

The rotor wheel 100 corresponds to a component that is rotatably installed in a casing of a gas turbine and is rotated in one direction when high pressure steam is supplied to the rotor wheel 100 to rotate the bucket 200.

The rotor wheel 100 has the plurality of dovetail grooves 110 provided in an axial direction at a predetermined interval and the platform seating part 120 constantly formed between the dovetail grooves, in which the dovetail groove 110 is not necessarily limited to the shape illustrated in the drawings.

The platform seating part 120 is horizontally extended in the axial direction of the rotor wheel 100 and the extended upper surface is maintained in an adhering state to the lower surface of the base platform 205 when the bucket 200 is inserted into the dovetail groove 110.

The bucket 200 includes the platform 202 having a shape corresponding to the dovetail groove 110, the base platform 205 formed at an upper portion of the platform 202 and having a plate shape, and a vane 210 extended to the upper portion of the base platform 205.

Figure 4:
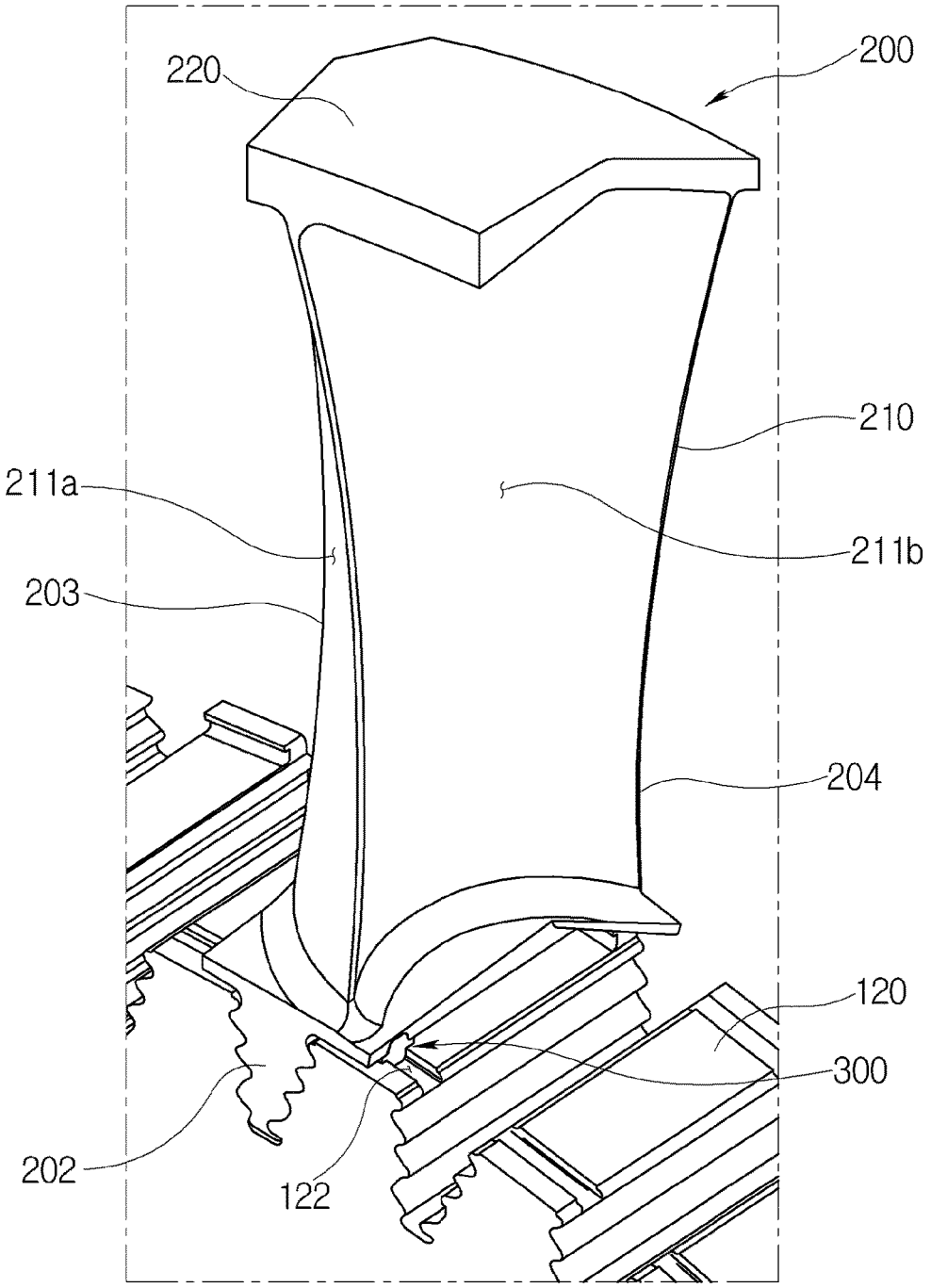
FIG. 4 is a perspective view illustrating a fixed state using a first fixture of a fixture for a bucket for a turbine blade according to one embodiment of the present disclosure.

Referring to FIG. 4, a left side of the vane 210 corresponds to a suction surface 211*a*, a right side thereof corresponds to a pressure surface 211*b*, and an upper end of the vane 210 is provided with a shroud 220. With respect to the drawings, a left surface and a right surface of the shroud 220 are not flatly extended and therefore have a triangular shape.

In the case in which the shroud 220 is configured as described above, the plurality of buckets may be assembled in the adhering state when the plurality of buckets are assembled on the adjacent rotor wheel 100, thereby improving assembling safety.

The bucket 200 has a front end provided with a leading edge 203 and a back end provided with a trailing edge 204, with respect to the vane 210. A lower side of the leading edge 203 is provided with the first insertion groove 122 and the lower surface of the base platform 205 facing the first insertion groove 122 is provided with the second insertion groove 201, such that the bucket 200 may be stably fixed at the leading position by the first fixture 300 to be described below.

The bucket 200 is fitted in the plurality of dovetail grooves 110 formed along the circumferential direction of the rotor wheel 100 and a worker may sequentially assemble, for example, the bucket 200 clockwise or may assemble the bucket 200 in another direction according to a field situation.

The platform seating part 120 is provided with the first insertion groove 122 along the circumferential direction of the rotor wheel 100, in which the first insertion groove 122 is formed to stably maintain the fixing of the bucket 200.

As described above, the platform seating part 120 has the upper surface provided with the first insertion groove 122 and the back end provided with a stepped portion 120*a* steppe upwardly, in which the stepped portion 120*a* is maintained to be fixed in the adhering state in which the stepped portion 120*a* and a protrusion 120 adhere to each other when the protrusion 120*b* (see FIG. 5) protruding from the lower surface of the base platform 205 of the bucket 200 is engaged with the stepped portion 120*a*.

The stepped portion 120*a* has a shape stepped from the back end at a predetermined height with respect to the upper surface of the platform seating part 120 and is maintained in the state in which it is engaged with the protrusion 120*b*, such that the bucket 200 is stably fixed on the rotor wheel 100 even when the high pressure steam is transferred to the bucket 200.

The first insertion groove 122 is formed to face the second insertion groove 201 and the bucket 200 is maintained to be stably fixed at the trailing position corresponding to the front end of the bucket 200 by the first fixture 300 to be described below.

Further, the locked state between the stepped portion 120*a* and the protrusion 120*b* is maintained at the trailing position of the bucket 200 to prevent the bucket 200 from moving and separating due to the high pressure steam, such that the first mounted position of the bucket 200 is stably maintained.

In particular, when the high temperature steam moves to the bucket 200, the bucket 200 is stably maintained in the fixed state at both of the leading position and the trailing position of the foregoing bucket 200, such that the bucket may be maintained in the stably assembled state even when the bucket is re-assembled after the bucket is used for a long period of time or the bucket positioned at a specific position is separated for repairing. Therefore, the fixed stability for the bucket may be improved and the worker may conveniently and accurately perform the assembling operation for the bucket 200.

In particular, it is advantageous to maintain the bucket 200 in the stably fixed state by the first fixture 300 fixing a portion where the leading edge 203 is formed in terms of the overall efficiency and maintenance of the turbine.

For example, when the high pressure steam is supplied to the bucket 200, the front surface of the bucket 200 is continuously applied with a high pressure and is applied with a force to move backwardly in the axial direction of the rotor wheel 100.

In this case, the first fixture 300 may differently adjust a force to vertically lift up the bucket 200 in the dovetail groove 100 depending on the position. Further, as the first fixture 300 is inserted into a position close to the leading edge 203, the phenomenon of vertically lifting up the bucket 200 may be reduced, and as a result the separation due to the rotation of the rotor wheel 100 may be reduced.

Figure 2:
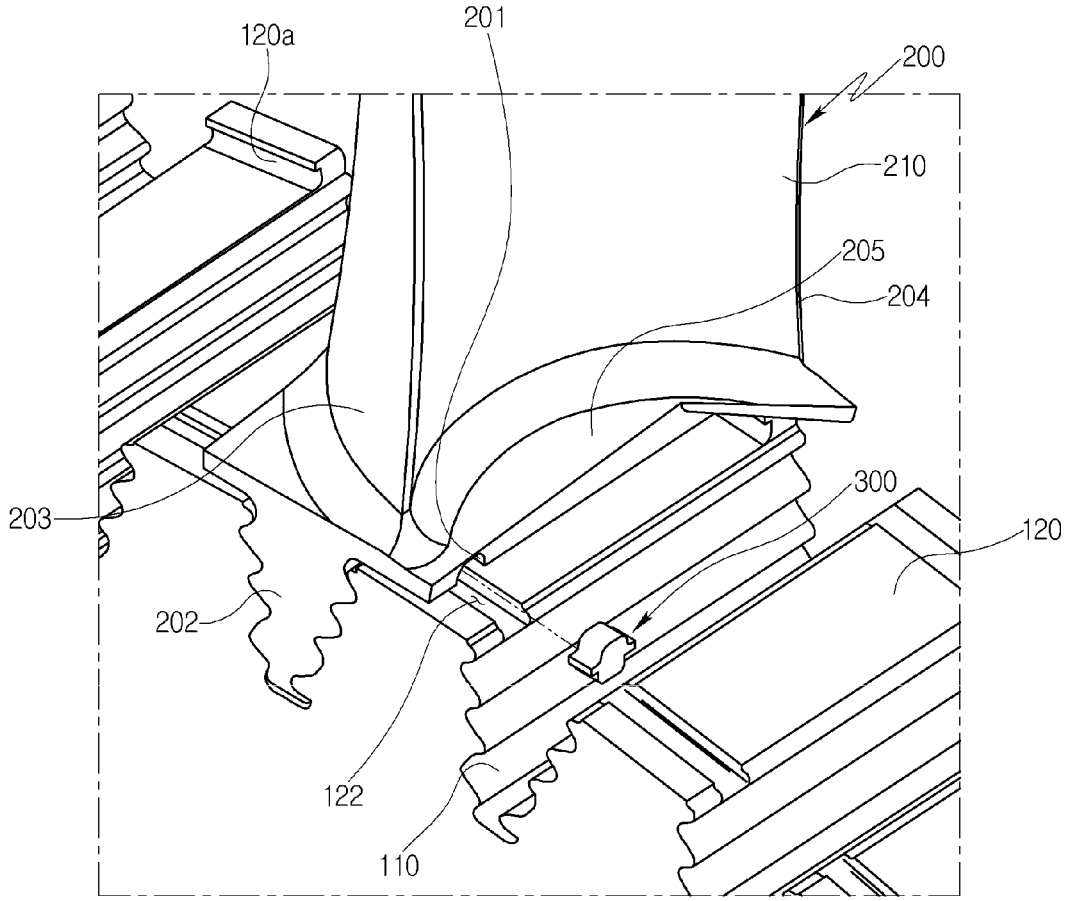
FIG. 2 is a perspective view illustrating a fixed state using a first fixture of a fixture for a bucket for a turbine blade according to one embodiment of the present disclosure.
Figure 3:
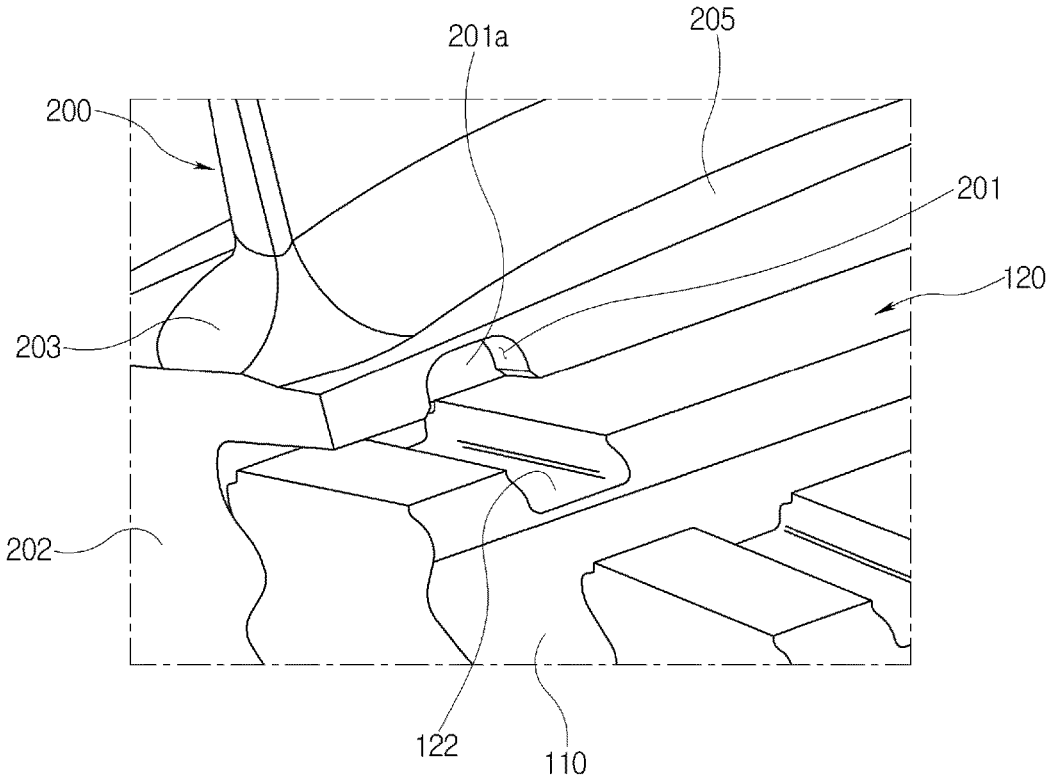
FIG. 3 is a perspective view illustrating a fixed state using a first fixture of a fixture for a bucket for a turbine blade according to one embodiment of the present disclosure.

For reference, the first insertion groove 122 may be formed in the shape illustrated in the drawings or the shape corresponding to the first fixture 300 to be described below or may be changed to have other shapes The first insertion groove 122 may be selectively disposed at a central position with respect to a center of the upper surface of the platform seating part 120 or any position between the front end and the center and the present embodiment describes only the case in which the first insertion groove 122 is formed at the position of the front end as illustrated in FIG. 2 or 3.

Unlike the foregoing embodiment, the first insertion groove 122 may be positioned at the center of the platform seating part 120 and may be formed at any position between the front end and the center of the platform seating part 120, if the first insertion groove 122 passes through the center but is not formed at the position of the back end, the bucket 200 may be maintained in the stably fixed state.

Figure 5:
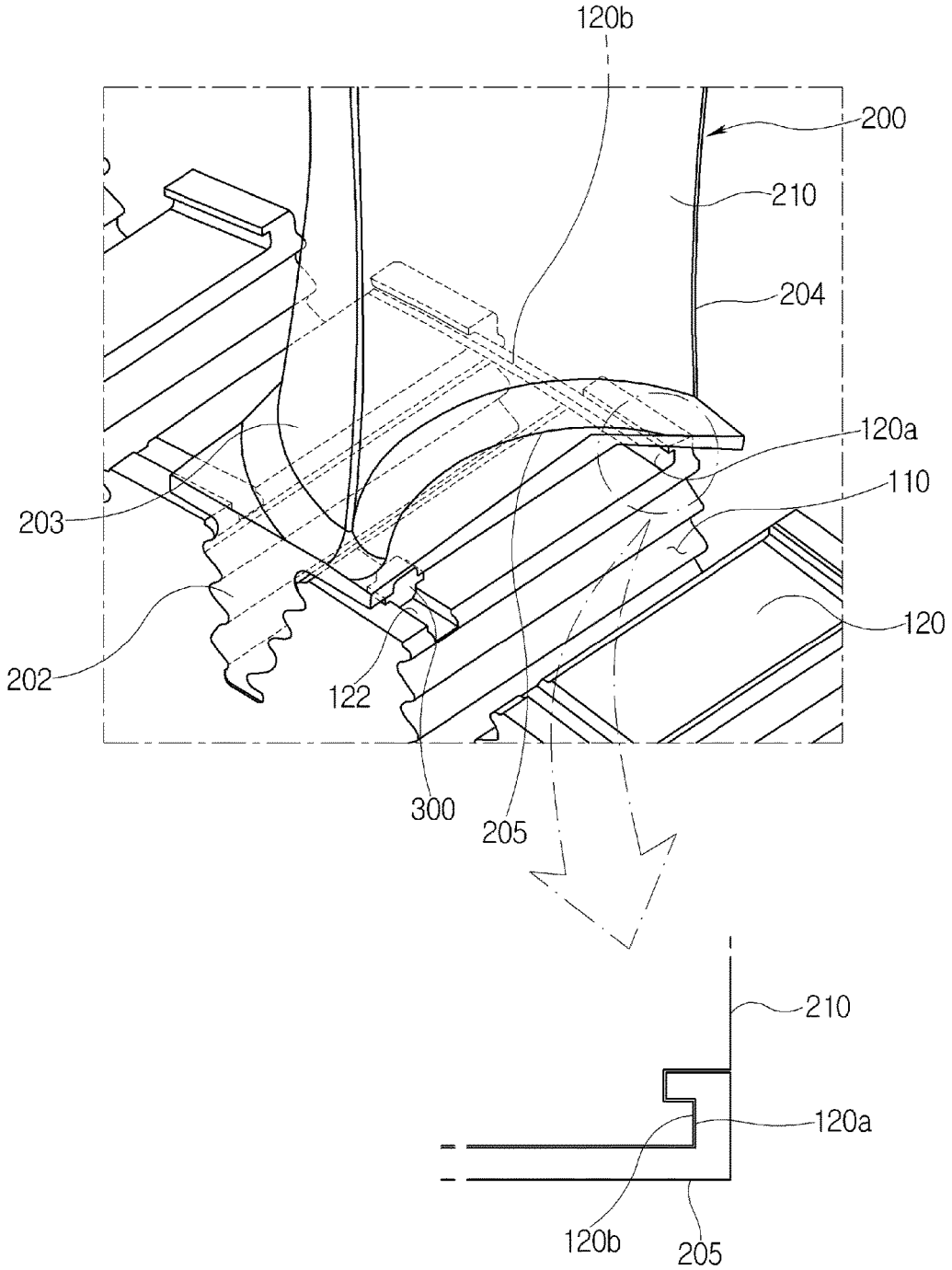
FIG. 5 is a perspective view illustrating a fixed state using a first fixture of a fixture for a bucket for a turbine blade according to one embodiment of the present disclosure.

Referring to FIG. 5, the bucket 200 includes the platform 202 inserted into the dovetail groove 110 and the base platform 205 positioned at the upper portion of the platform 202 and having the second insertion groove 201 at the position facing the first insertion groove 122. The base platform 204 has a plate shape and is formed at a lower end of the vane 210.

The first fixture 300 is fitted in the internal area formed when the first insertion groove 122 and the second insertion groove 201 are positioned in a state in which they face each other and is fitted in, for example, an arrow direction based on FIG. 5.

When the bucket 200 is assembled in the dovetail groove 110, to maintain the buckets previously mounted in the circumferential direction toward a spread state, a worker uses a separate tool to maintain the buckets in a spread state and if the buckets are positioned at any position and then the tool is separated, the buckets are maintained in the mounted state by the force applied in the circumferential direction.

Next, if the worker fits the first fixture 300 between the first insertion groove 122 and the second insertion groove 201 and then removes the tool widening the buckets, the buckets are stably coupled in the dovetail groove 110.

A front surface inside the foregoing second insertion groove 201 is provided with a partition wall 201*a* with respect to a direction in which the first fixture 300 is inserted to maintain the first fixture 300 in the state in which the first fixture 300 is inserted into a specific position when the first fixture 300 is inserted into the second insertion groove 201.

The partition wall 201*a* may be accurately positioned at the defined insertion position when the first fixture 300 is inserted, and thus the first fixture 300 is prevented from being excessively inserted or unstably inserted into the first and second insertion grooves 122 and 201, such that the first fixture 300 maintains the stably coupled state.

Figure 6:
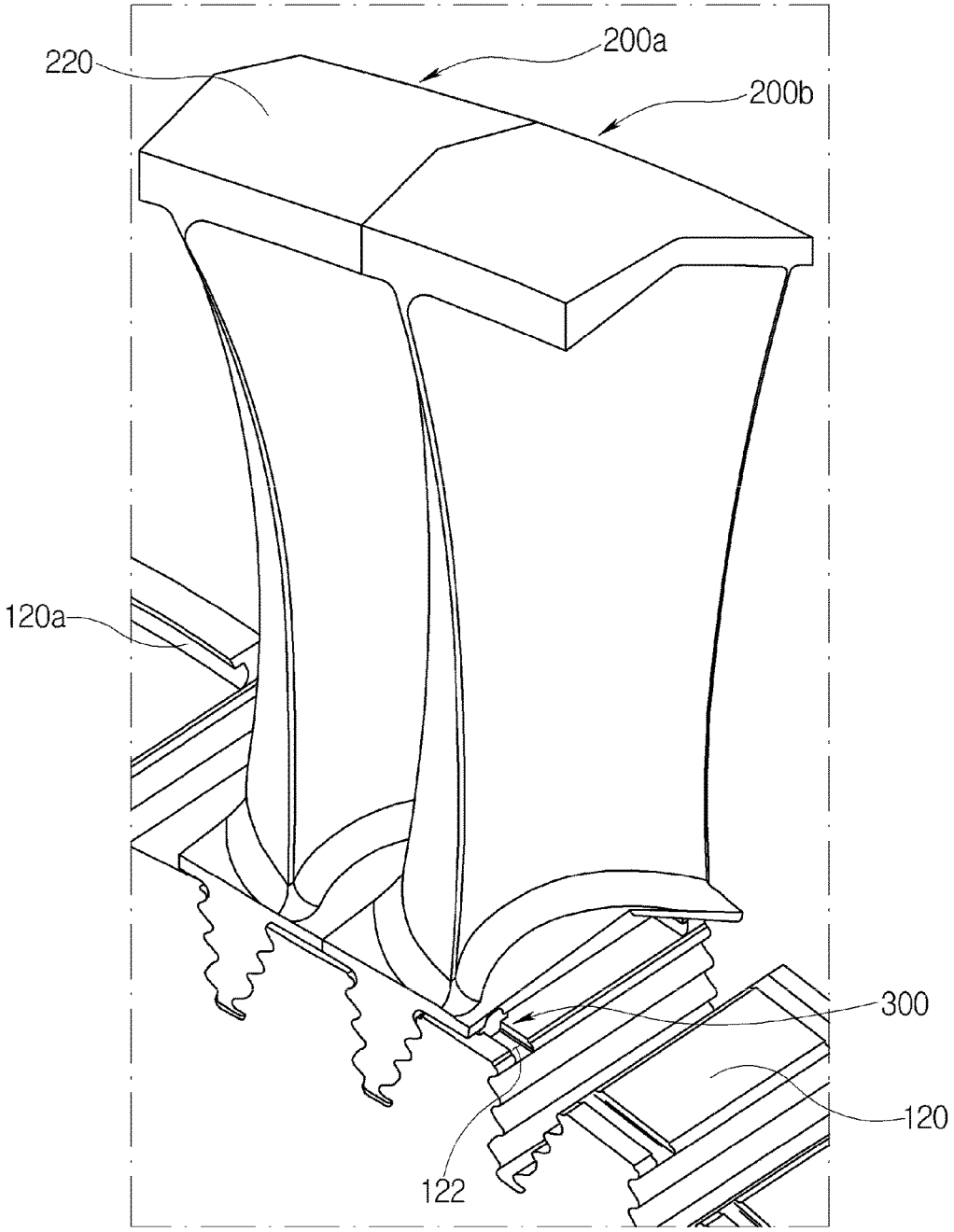
FIG. 6 is a perspective view illustrating a state in which the fixture for the bucket for the turbine blade according to one embodiment of the present disclosure is sequentially installed.

As illustrated in FIG. 6, when the first fixture 300 is inserted into the second insertion groove 201, the bucket is maintained in the fixed state and the worker may easily install the plurality of buckets in the rotor wheel 100 by the foregoing method. Therefore, the stability of the installation work of the bucket 200 by the worker may be improved and the worker may more conveniently install the bucket 200.

The state in which the final bucket is mounted on the rotor wheel according to one embodiment of the present disclosure will be described with reference to the drawing.

Figure 7:
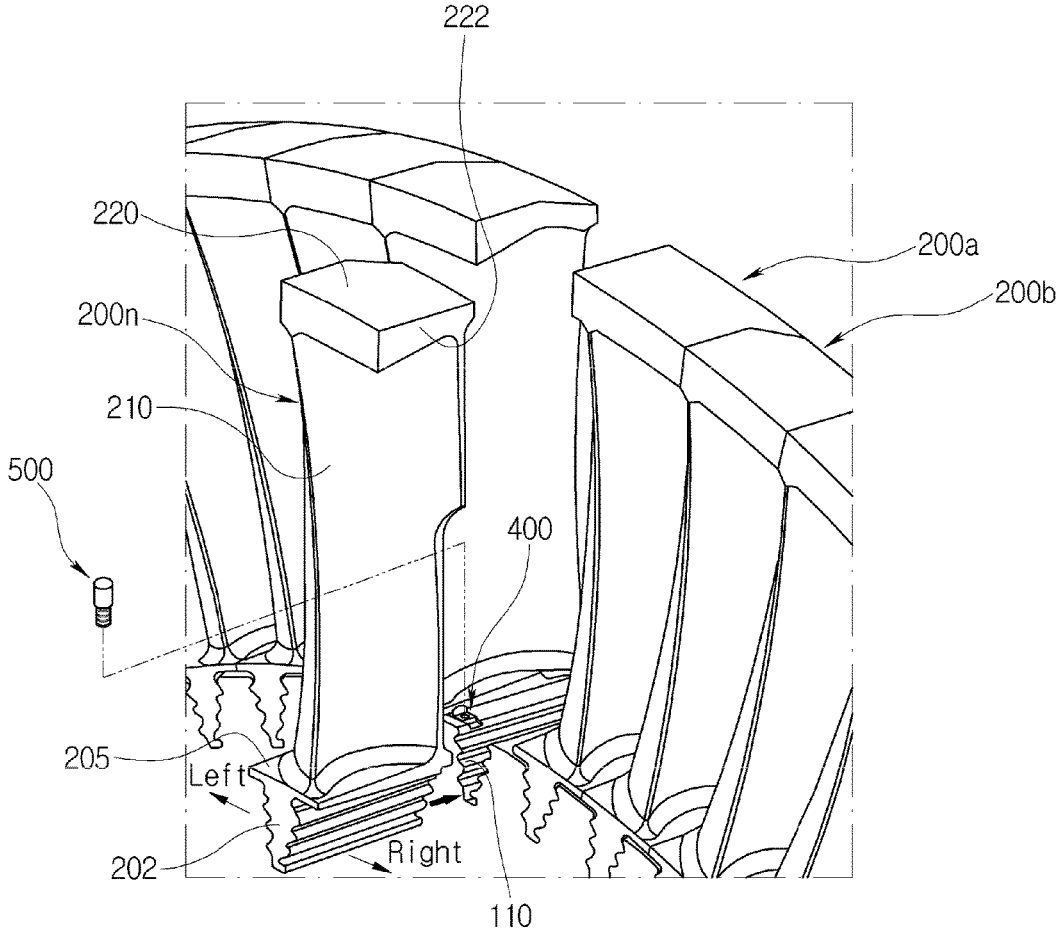
FIG. 7 is a perspective view illustrating a state in which the fixture for the bucket for the turbine blade according to one embodiment of the present disclosure is sequentially installed.
Figure 8:
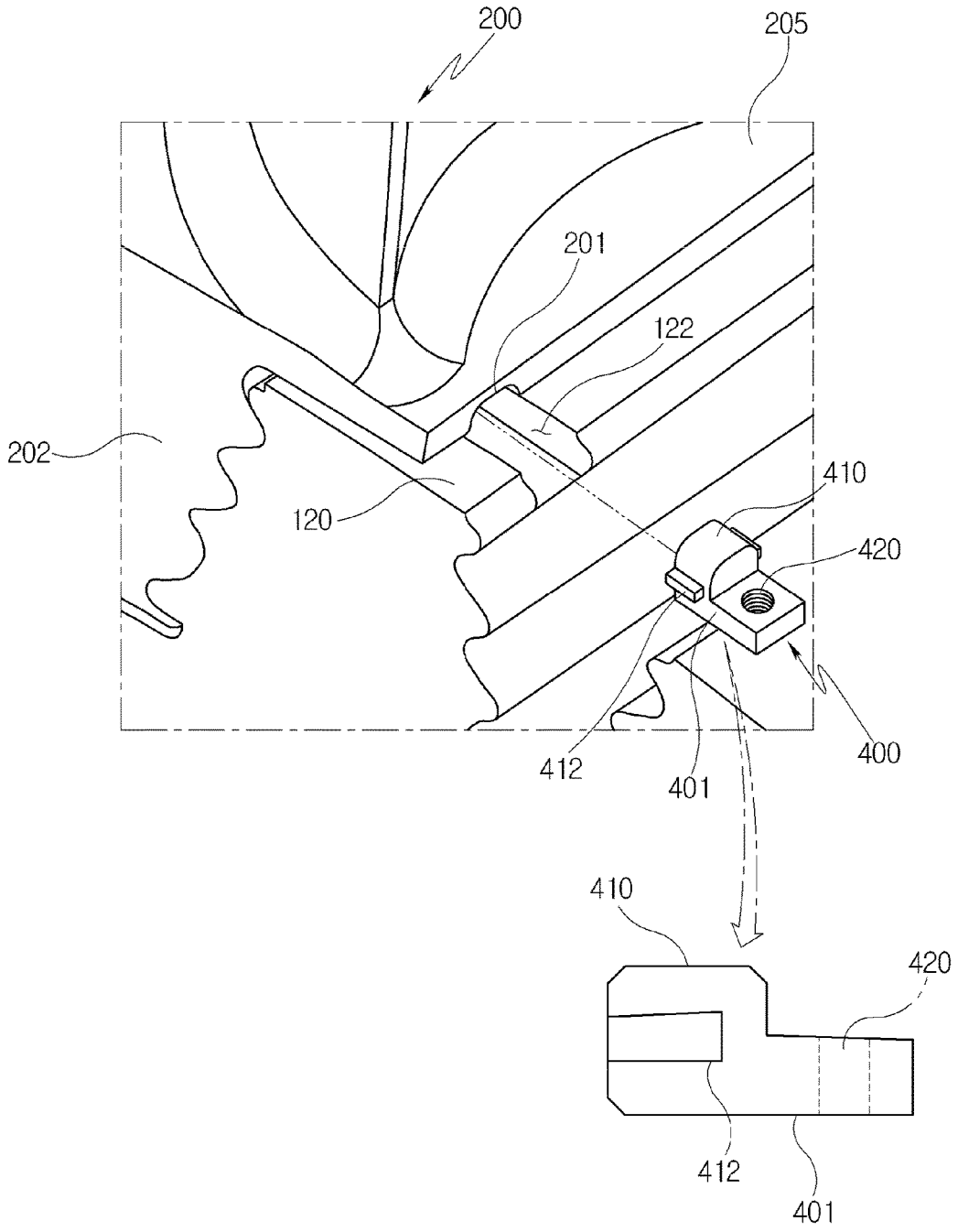
FIG. 8 is a perspective view illustrating a state in which the final bucket according to one embodiment of the present disclosure is installed.

Referring to FIGS. 7 and 8, unlike the foregoing first fixture 300, a second fixture 400 for fixing the final bucket 200*n* includes a body part 401 configured to be extended by a predetermined length so that it is inserted into the first insertion groove 122 and have a third insertion groove 420 formed at a position facing the second insertion groove 201, a protruding piece 410 configured to protrude upwardly from a position spaced apart from the third insertion groove 420 in a length direction of an upper surface of the body part 410, and blade parts 412 configured to be extended to be downwardly inclined backwardly from the length directions of the left and right sides of the protruding piece 410.

The third insertion groove 420 is formed to penetrate in a vertical direction for an insertion of an auxiliary fixture 500 to be described below and the blade part 412 is extended to be downwardly inclined backwardly (left in the drawings) when viewed from the side surface of the body part 401.

Since the second fixture 400 is assembled in the circumferential direction of the rotor wheel 100, when the second fixture 400 is inserted into the first and second insertion grooves 122 and 201 by the blade part 412 inclined at a predetermined angle, the insertion direction of the second fixture 400 may be guided and may be more easily inserted.

Therefore, when the worker performs the insertion work of the second fixture 400 at the side surface of the rotor wheel 100, he/she may conveniently perform the work and thus the workability is improved.

Since the protruding piece 410 is vertically extended upwardly from the upper surface of the body part 401 and is formed in the size and form corresponding to the partition wall 201*a*, the worker may predict the insertion position by maintaining the protruding piece 410 and the partition wall 201*a* in the adhering state when the fixture 400 is inserted into a space formed in the first and second insertion grooves 122 and 201.

The second fixture 400 is used to allow the worker to stably install and fix the final bucket 200*n*. Unlike the foregoing buckets 200*a*, 200*b* . . . , the final bucket 200*n* is not fixed at the right position with respect to the upper surface of the platform seating part 120 when viewing the bucket 200 from the front surface but is stably fixed at the left position by the second fixture 400 and the auxiliary fixture 500 to be described below.

Referring to FIGS. 6 to 8, to assemble the bucket 200 in the rotor wheel 100, the worker inserts the first bucket 200*a* into the dovetail groove 110 and fixes it using the first fixture 300. Thereafter, the second to n-th buckets 200*b* to 200*n* are sequentially assembled in the adjacent dovetail grooves 110. For example, the second to n-th buckets 200*b* to 200*n* are sequentially assembled in the respective dovetail grooves 110 disposed clockwise. After the assembling as described above, the second fixture 400 is inserted into the second insertion groove 201 before the final bucket 200*n* is assembled.

Figure 9:
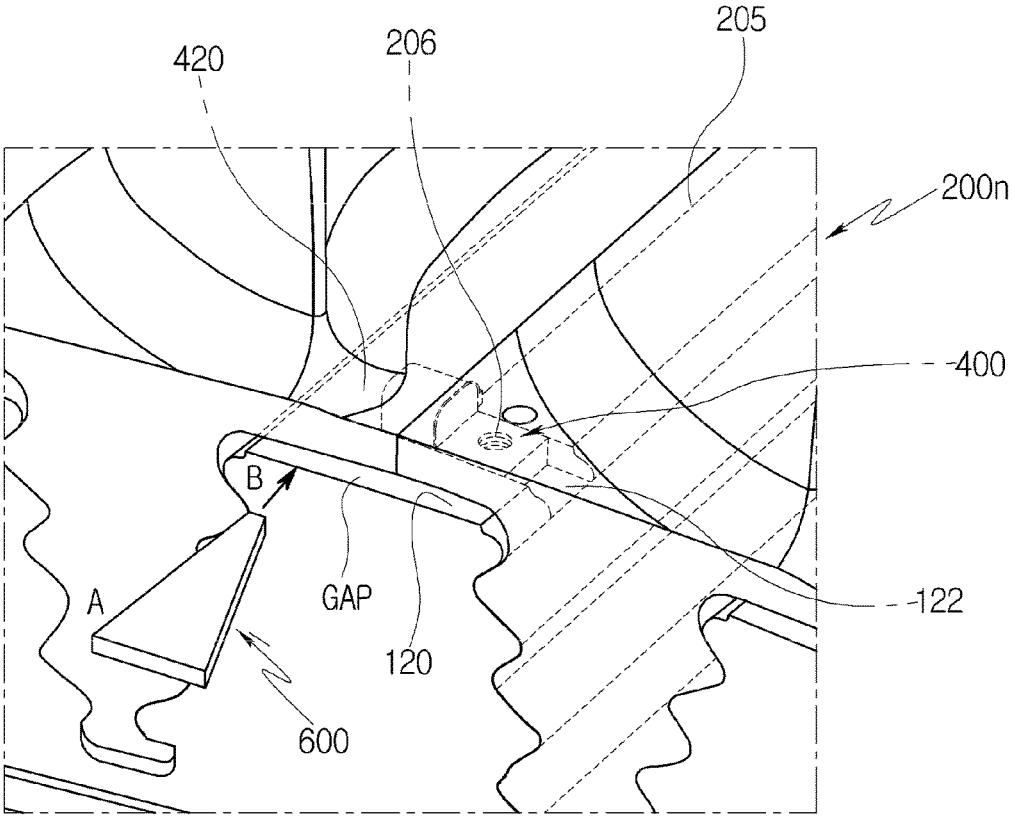
FIG. 9 is a perspective view illustrating a state in which the final bucket according to one embodiment of the present disclosure is installed.
Figure 10:
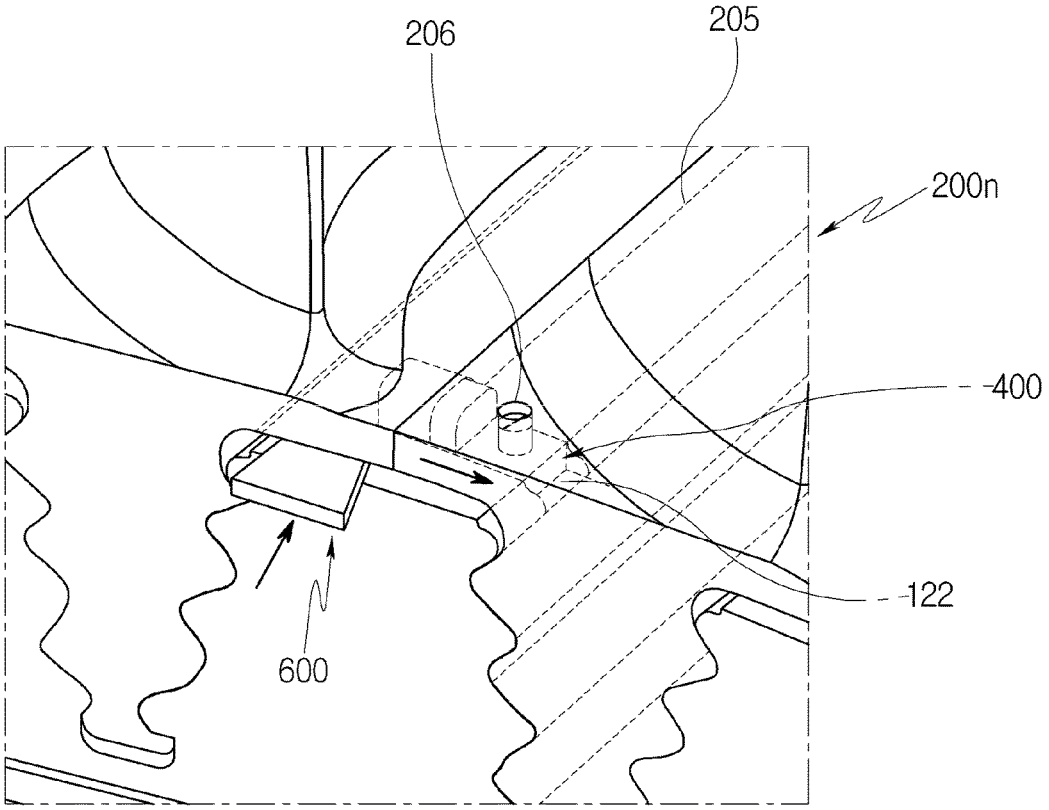
FIG. 10 is a perspective view illustrating a state in which the final bucket according to one embodiment of the present disclosure is installed.
Figure 11:
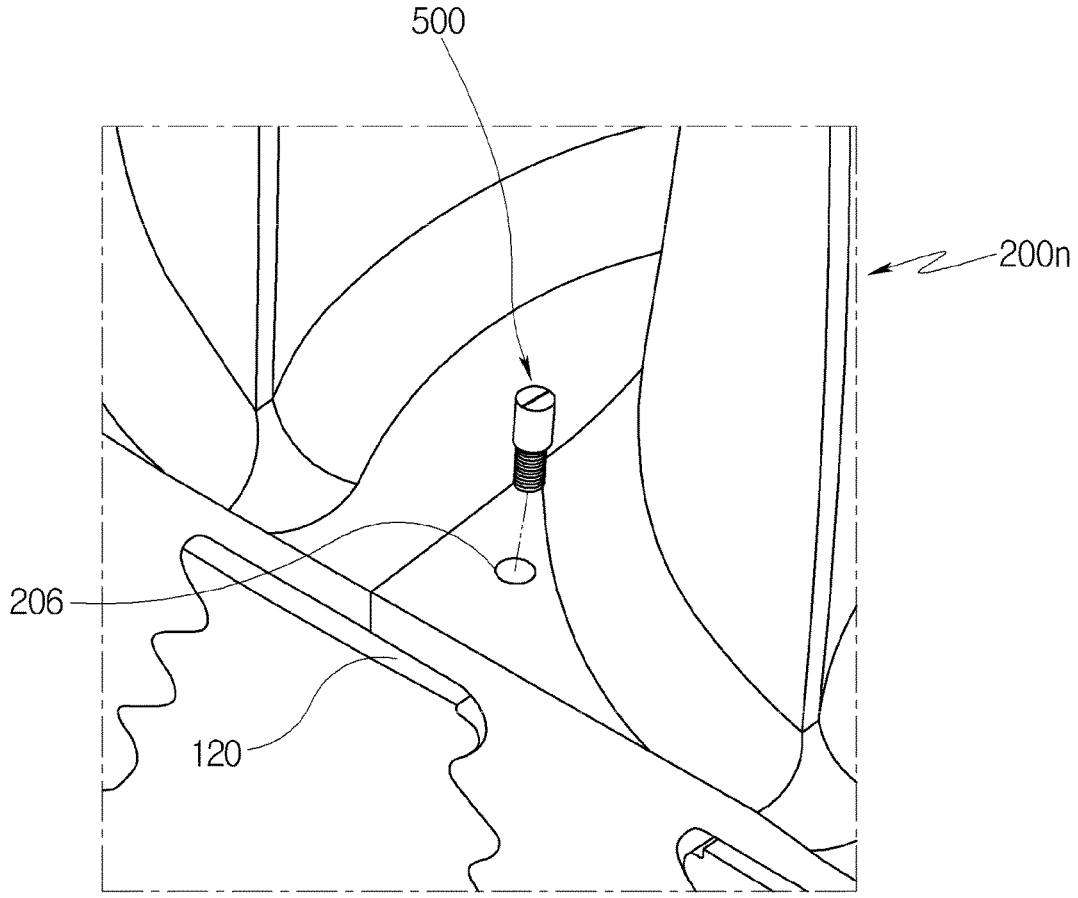
FIG. 11 is a perspective view illustrating a state in which the final bucket according to one embodiment of the present disclosure is installed.

Referring to FIGS. 9 to 11, when the second fixture 400 is inserted into the space formed by the first and second insertion grooves 122 and 201, the insertion position is not adjusted once, and therefore the worker needs to manually adjust the accurate insertion position of the second fixture 400.

For example, the worker inserts an adjustment member 600 from position A to position B at a gap formed between the upper surface of the platform seating part 120 and the lower surface of the base platform 205 to adjust the accurate insertion position of the second fixture 400. For reference, the gap is maintained a spaced state by a predetermined length in consideration of a thermal expansion.

As the adjustment member 600, a triangular wedge is used and the adjustment member 600 is inserted in the gap formed between the platform seating part 120 and the lower surface of the base platform 205.

The adjustment member 600 is pressed by a hammer or a tool (not illustrated) similar to the hammer from position A toward position B, the second fixture 400 moves from the space of the first and second insertion grooves 122 and 201 toward the right arrow direction with respect to the drawings by the adjustment member 600.

The worker checks whether the third insertion groove 420 of the second fixture 400 matches the opening hole 206 and if not matched, adjusts the position of the auxiliary fixture 500 to perform the hole matching of the third insertion groove 420 and the opening hole 206.

Here, the reason why the worker perform the positioning using the adjustment member 600 is that the hole matching with the opening hole 206 formed in the final bucket 200*n* facing the third insertion groove 420 is accurately performed to easily insert the auxiliary fixture 500.

For this purpose, the base platform 205 of the final bucket 200*n* is provided with the opening hole 206 opened downwardly from above, and thus the worker may easily confirm the matched state of the third insertion groove 420 and the opening hole 206 with the naked eye before the auxiliary fixture 500 is inserted. Therefore, when the third insertion groove 420 and the opening hole 206 match each other, the auxiliary fixture 500 is inserted.

In this case, since the auxiliary is maintained in the state in which it is inserted into the second fixture 400 via the final bucket 200*n*, the stable position fixing and assembling of the final bucket 200*n* may be simultaneously performed.

The auxiliary fixture 500 is inserted into the opening hole 206 formed in the final bucket 200*n* and the auxiliary fixture 500 is inserted into the second fixture 400 and then is fixed to the final bucket 200*n* while the upper surface of the auxiliary fixture 500 goes through caulking processing.

Here, the caulking processing means that the upper surface of the auxiliary fixture 500 is applied with a specific pressure to be intentionally deformed. By doing so, the auxiliary fixture 500 is prevented from being separated from the outer side of the final bucket 200*n*.

Therefore, the worker may more easily mount the final bucket 200*n* on the rotor wheel 100, thereby simultaneously improving the workability and work efficiency of the worker.

The final bucket 200*n* according to the present embodiment has substantially the same structure as the foregoing bucket and is provided with an extending surface 222 to which a right surface (with respect to the drawing) of the shroud 220 is flatly extended, such that the final bucket 200*n* is maintained in the state in which it adheres to one surface of the shroud of the adjacent buckets 200.

The assembling method of the turbine blade according to the embodiment of the present disclosure will be described with reference to the drawings.

Figure 12:
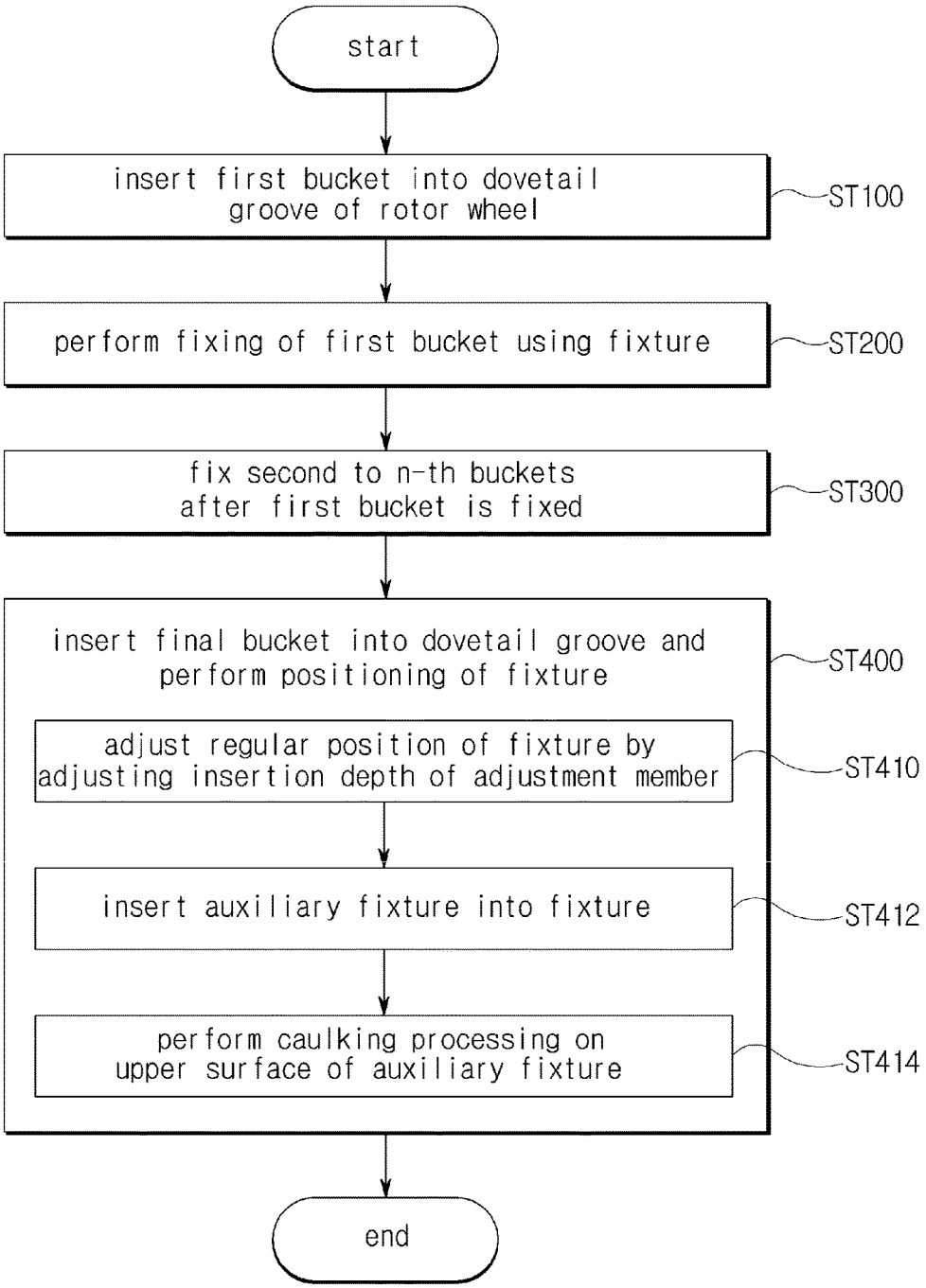
FIG. 12 is a flow chart illustrating an assembling method of a bucket for a turbine blade according to one embodiment of the present disclosure.

Referring to FIG. 12, the assembling method of the turbine blade according to the embodiment of the present disclosure includes: a first bucket inserting step (ST100) of inserting the first bucket into any one of the plurality of dovetail grooves provided on the circumferential direction of the rotor wheel and then performing assembling in the state in which the first bucket is engaged with the leading position corresponding to the front end and the trailing position corresponding to the back end, respectively, with respect to the axial direction of the first bucket; a step (ST200) of fixing the first bucket using the fixture; a second to n-th bucket fixing step (ST300) of fixing the first bucket and then sequentially fixing the rest buckets to the dovetail grooves adjacently disposed to the first bucket; and a step (ST400) of inserting the final bucket into the dovetail groove and fixing the final bucket by positioning of the fixture.

In the step (ST400) of fixing the final bucket (ST400), the regular position adjustment is performed on the fixture by selectively adjusting the insertion depth of the adjustment member inserted into the lower surface of the platform of the final bucket.

The step (ST400) of fixing the final bucket includes a step (ST412) of performing the regular position adjustment is performed on the fixture and then inserting the auxiliary fixture coupled with the fixture at the outer side of the final bucket and a step (ST414) of performing the caulking processing on the upper surface of the auxiliary fixture to prevent the auxiliary fixture from being separated.

In the first bucket inserting step (ST100), when the first bucket inserted into the first dovetail groove is fixed, the fixing is performed at the leading position and the trailing position of the first bucket to prevent the first bucket from moving to the front of the dovetail groove.

The fixing of the first bucket is performed by the first fixture at the leading position (ST200) and the fixing method of the first fixture is already described and therefore the description of the fixing method will be omitted.

By the foregoing method, the fixing of the rest bucket is sequentially performed along the circumferential direction of the rotor wheel (ST300) and the regular position adjustment of the second fixture is performed by adjusting the insertion depth of the adjustment member to insert the second fixture into the first and second insertion grooves before the final bucket 200*n* is assembled and then perform the regular position adjustment of the second fixture (ST400).

Here, the regular position adjustment of the second fixture means the operation of matching the third insertion groove of the second fixture and the opening hole formed on the upper surface of the base platform of the final bucket 200*n* each other. The insertion depth of the adjustment member is already described and therefore the detailed description thereof will be omitted.

The worker adjusts the position of the second fixture and then inserts the auxiliary fixture into the second fixture (ST410) and performs the caulking processing on the upper surface of the auxiliary fixture as described above to prevent the auxiliary fixture from being separated to thereby prevent the final bucket from being separated from the dovetail groove.

According to the embodiments of the present disclosure, the worker may easily perform the mounting of the plurality of buckets and the final bucket mounted on the rotor wheel, thereby improving the workability of the worker and saving costs.

According to the embodiments of the present disclosure, the bucket may be stably maintained in the fixed state at two places corresponding to the positions of the leading edge and the trailing edge of the bucket to previously prevent the occurrence and failure of accidents due to the separation of the bucket.

Hereinabove, the embodiment of the present disclosure has been described, but a person having ordinary skill in the art may variously, change, delete, add, etc., components without deviating from the ideas of the present disclosure.

The breadth and scope of the present disclosure should not be limited by any of the above-described exemplary embodiments, but should be defined only in accordance with the following claims and their equivalents. Moreover, the above advantages and features are provided in described embodiments, but shall not limit the application of the claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Further, a description of a technology in the "Background" is not to be construed as an admission that technology is prior art to any invention(s) in this disclosure. Neither is the "Brief Summary" to be considered as a characterization of the invention(s) set forth in the claims found herein. Furthermore, any reference in this disclosure to "invention" in the singular should not be used to argue that there is only a single point of novelty claimed in this disclosure. Multiple inventions may be set forth according to the limitations of the multiple claims associated with this disclosure, and the claims accordingly define the invention(s), and their equivalents, that are protected thereby. In all instances, the scope of the claims shall be considered on their own merits in light of the specification, but should not be constrained by the headings set forth herein.

What is claimed is:

1. A fixture for a bucket for a turbine blade, comprising:

a rotor wheel that is axially mounted on a rotor and includes a plurality of dovetail grooves extending in an axial direction of the rotor, respectively, the dovetail grooves arranged so as to be spaced apart from each other along a circumference of the rotor wheel, and a plurality of platform seats disposed between the dovetail grooves, each platform seat including a first insertion groove communicating with each of an adjacent pair of dovetail grooves among the plurality of dovetail grooves;

a plurality (n) of buckets sequentially mounted on the rotor wheel, each bucket including a platform that inserts into one of the dovetail grooves adjacent to one of the platform seats, and a base platform disposed on an upper surface of the platform, the base platform including a second insertion groove configured to face the first insertion groove of the one of the platform seats and to define an internal area between the first and second insertion grooves when the platform is inserted into the one of the dovetail grooves, wherein the plurality of buckets includes a final bucket that is mounted last among the sequentially mounted plurality of buckets, the final bucket having a base platform including one side facing in a first circumferential direction, the base platform of the mounted final bucket having an opening hole formed toward the one side;

a plurality (n−1) of first fixtures corresponding to a first bucket of the plurality of buckets through the (n−2)th bucket of the plurality of buckets, the first fixtures inserted in the first circumferential direction into the internal areas of the first bucket through the (n−2)th bucket, respectively;

a second fixture operable to be inserted in the first circumferential direction into the internal area of the (n−1)th bucket of the plurality of buckets; and an auxiliary fixture operable to be inserted into the opening hole formed in the base platform of the final bucket and to engage with the second fixture.

2. The fixture of claim 1, wherein the first insertion groove of each platform seat of the plurality of platform seats is formed in an upper surface of a corresponding platform seat of the plurality of platform seats and is disposed at a leading position corresponding to a front end with respect to the axial direction.

3. The fixture of claim 1, wherein the first insertion groove of each platform seat of the plurality of platform seats is formed in an upper surface of a corresponding platform seat of the plurality of platform seats and is disposed at a position between a front end with respect to the axial direction and a center of the upper surface of the corresponding platform seat.

4. The fixture of claim 1, wherein each bucket includes a protrusion protruding from a trailing position of a lower surface of the bucket, each platform seat includes a stepped portion stepped upwardly from a back end, and the stepped portion and the protrusion are operable to engage with each other.

5. The fixture of claim 1, wherein the second insertion grooves of the first bucket through the (n−2)th bucket each include a partition wall at a position facing a corresponding first fixture of the plurality of first fixtures with respect to the first circumferential direction to maintain the corresponding first fixture in a specific position when the first corresponding fixture is inserted into the second insertion groove.

6. The fixture of claim 1, wherein the second fixture includes blade parts formed on respective sides of a protruding piece that protrudes toward the second insertion groove, each blade part having at least one surface inclined downwardly in the first circumferential direction.

7. The fixture of claim 1, wherein the auxiliary fixture includes an upper surface operable to be pressed after the auxiliary fixture is inserted into the second fixture and to deform the auxiliary fixture by the pressing.

8. The fixture of claim 1, wherein the auxiliary fixture is fixed to the second fixture by adjusting a coupling position of the auxiliary fixture, and the coupling position of the auxiliary fixture is adjusted by temporarily inserting a wedge between a lower surface of the platform of the (n−1)th bucket and an upper surface of the corresponding platform seat to adjust a coupled position of the auxiliary fixture fixed to the second fixture.

9. The fixture of claim 8, wherein the second fixture is operable to move in the second insertion groove of the (n−1)th bucket by a distance in a second circumferential direction opposite to the first circumferential direction, depending on a depth at which the wedge is inserted.

10. The fixture of claim 1, wherein the final bucket includes:

a vane that extends toward an upper portion of an outer side with respect to the base platform; and a shroud at an upper end of the vane, the shroud including an extending surface to which an opposite surface toward buckets adjacent to the final bucket is flatly extended.

11. The fixture of claim 1, wherein the inserted second fixture includes a body arranged toward the first insertion groove and a protruding piece that protrudes from the body toward the second insertion groove, and the body of the second fixture includes a coupling surface facing toward the second insertion groove and extending from the protruding piece in a second circumferential direction opposite to the first circumferential direction.

12. The fixture of claim 11, wherein the coupling surface of the second fixture includes a third insertion groove disposed in opposition to the opening hole of the mounted final bucket.

13. The fixture of claim 1, wherein the second fixture includes a protruding piece that protrudes toward the second insertion groove and a coupling surface that is disposed under the one side of the base platform of the final bucket while the protruding piece is inserted into the internal area.

14. The fixture of claim 1, wherein the base platform of the final bucket includes a lower surface that overlaps the second fixture.

15. The fixture of claim 1, wherein each platform seat includes an upper surface that is flush with an uppermost edge of an adjacent dovetail groove.

16. A method of assembling a bucket, comprising:

inserting a first bucket into one of a plurality of dovetail grooves of a rotor wheel so that the first bucket is engaged with a leading position corresponding to a front end and a trailing position corresponding to a back end, respectively, with respect to an axial direction of the first bucket;

fixing the first bucket using a first fixture;

sequentially fixing a plurality of additional buckets to a plurality of dovetail grooves adjacently disposed to the first bucket; and inserting a final bucket into a dovetail groove and fixing the final bucket by positioning of a second fixture, wherein the fixing the final bucket includes adjusting a position of the second fixture by temporarily inserting a wedge under a lower surface of a platform of the final bucket and moving the second fixture in a circumferential direction of the rotor wheel according to a depth of the inserted wedge.

17. The assembling method of claim 16, wherein the fixing the final bucket includes:

adjusting the position of the second fixture and then coupling an auxiliary fixture with the second fixture at an outer side of the final bucket; and applying pressure to an upper surface of the auxiliary fixture to deform the auxiliary fixture.

* * * * *